US009192850B2

(12) United States Patent
Geith et al.

(10) Patent No.: US 9,192,850 B2
(45) Date of Patent: Nov. 24, 2015

(54) ILLUMINATED FLOOR ASSEMBLY

(75) Inventors: Andreas Geith, Aachen (DE); Walter Schreiber, Aachen (DE); Oliver Krause, Marienheide (DE); Horst Babinsky, Grabenstätt-Marwang (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 658 days.

(21) Appl. No.: 13/500,063

(22) PCT Filed: Oct. 4, 2010

(86) PCT No.: PCT/EP2010/064735

§ 371 (c)(1),
(2), (4) Date: Jul. 31, 2012

(87) PCT Pub. No.: WO2011/042385

PCT Pub. Date: Apr. 14, 2011

(65) Prior Publication Data

US 2012/0297713 A1 Nov. 29, 2012

(30) Foreign Application Priority Data

Oct. 5, 2009 (DE) ..... 10 2009 044 180

(51) Int. Cl.
*E04B 5/46* (2006.01)
*A63C 19/06* (2006.01)
(Continued)

(52) U.S. Cl.
CPC ..... *A63C 19/065* (2013.01); *E04B 5/46* (2013.01); *E04F 15/024* (2013.01); *F21S 8/022* (2013.01); *E04F 2290/026* (2013.01)

(58) Field of Classification Search
CPC .. F21S 8/022; A63C 19/065; E04F 2290/026; E04F 15/024; E04B 5/46; B64D 11/00; B64D 2011/0038; Y02T 50/46
USPC ..... 52/28, 177, 220.1, 220.5, 220.8, 263, 52/306, 403.1, 480; 362/145, 153–153.1; 472/92
See application file for complete search history.

(56) References Cited

U.S. PATENT DOCUMENTS 312,269 A * 2/1885 Higley ..... 362/153
2,457,619 A * 12/1948 Yoeum ..... 62/235
(Continued)

FOREIGN PATENT DOCUMENTS

DE 3925742 7/1991
DE 102005059076 A1 * 8/2006
(Continued)

OTHER PUBLICATIONS

Machine Translation of French Patent 2752912 A1 provided by the European Patent Office (last accessed on Aug. 25, 2014).*
(Continued)

*Primary Examiner* — Charles A Fox
*Assistant Examiner* — Charissa Ahmad
(74) *Attorney, Agent, or Firm* — Steinfl & Bruno LLP

(57) ABSTRACT

An illuminated floor assembly, comprising: a composite floor panel; an overlay; a polymer block and an LED light channel between the composite glass floor panel and the overlay; a hook-and-loop fastener between the polymer block and the composite glass floor panel; and a support between the overlay and the hallway foundation.

25 Claims, 4 Drawing Sheets

Figure 1:
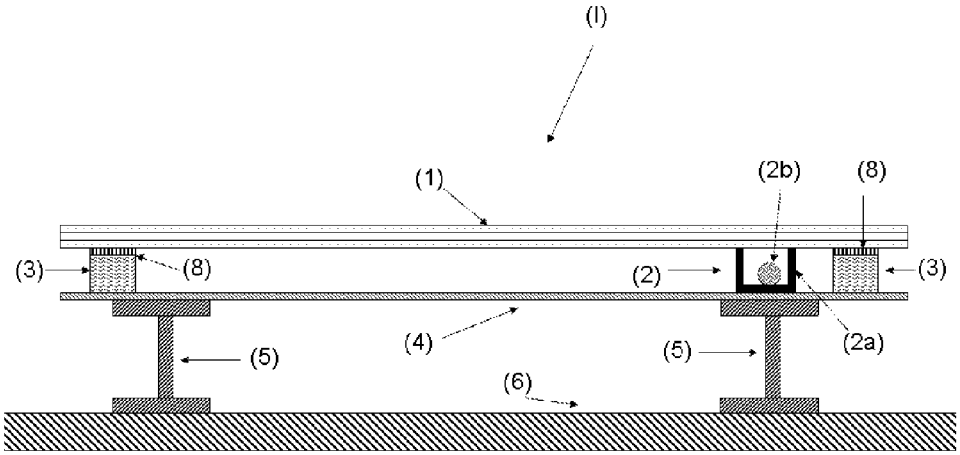

(51) Int. Cl.
*F21S 8/02* (2006.01)
*E04F 15/024* (2006.01)

(56) References Cited

U.S. PATENT DOCUMENTS

| | | | | | |
|---|---|---|---|---|---|
| 2,956,652 | A * | 10/1960 | Liskey, Jr. | 52/126.6 |
| 3,065,506 | A * | 11/1962 | Tremer | 52/126.6 |
| 3,318,057 | A * | 5/1967 | Norsworthy | 52/126.6 |
| 4,303,969 | A * | 12/1981 | Hamilton et al. | 362/153 |
| 4,329,739 | A * | 5/1982 | Loebner | 362/153 |
| 4,340,929 | A * | 7/1982 | Konikoff et al. | 362/153 |
| 4,449,342 | A * | 5/1984 | Abendroth | 52/393 |
| 4,737,764 | A * | 4/1988 | Harrison | 362/153 |
| 5,095,412 | A * | 3/1992 | French | 362/153 |
| 5,390,090 | A * | 2/1995 | Nau | 362/153 |
| 6,070,381 | A | 6/2000 | Blumer | |
| 6,202,374 | B1 * | 3/2001 | Cooper et al. | 52/220.3 |
| 6,526,704 | B1 * | 3/2003 | Berard et al. | 52/177 |
| 6,672,426 | B2 * | 1/2004 | Kakimoto et al. | 181/290 |
| 6,732,478 | B1 * | 5/2004 | Russell et al. | 52/28 |
| 7,125,137 | B2 * | 10/2006 | Kitajima et al. | 362/153 |
| 7,607,793 | B2 * | 10/2009 | Coushaine et al. | 362/145 |
| 7,735,484 | B2 * | 6/2010 | Shin et al. | 126/704 |
| 7,841,737 | B2 * | 11/2010 | Manglardi | 362/230 |
| 7,918,579 | B2 * | 4/2011 | Hamar et al. | 362/153 |
| 8,220,949 | B2 * | 7/2012 | Hamar et al. | 362/153 |
| 8,299,719 | B1 * | 10/2012 | Moshirnoroozi | 315/185 R |
| 2002/0078638 | A1 * | 6/2002 | Huang | 52/126.6 |
| 2003/0110720 | A1 * | 6/2003 | Berard et al. | 52/263 |
| 2004/0074170 | A1 * | 4/2004 | Huang | 52/220.1 |
| 2007/0070618 | A1 * | 3/2007 | Talamo et al. | 362/153.1 |
| 2007/0153502 | A1 * | 7/2007 | Arriazu | 362/152 |
| 2008/0088258 | A1 * | 4/2008 | Ng | 315/294 |
| 2008/0287221 | A1 | 11/2008 | Babinsky et al. | |
| 2009/0034241 | A1 * | 2/2009 | Coushaine et al. | 362/145 |
| 2009/0103280 | A1 | 4/2009 | Peard et al. | |
| 2010/0284173 | A1 * | 11/2010 | Verjans et al. | 362/145 |

FOREIGN PATENT DOCUMENTS

| | | | | |
|---|---|---|---|---|
| DE | 202006009439 | | 8/2006 | |
| EP | 79066 | A1 * | 5/1983 | E04F 15/024 |
| EP | 0283406 | A1 * | 9/1988 | |
| EP | 0835969 | | 10/1997 | |
| FR | 2752912 | A1 * | 3/1998 | F21P 3/00 |
| FR | 2884026 | | 10/2006 | |
| GB | 2032989 | A * | 5/1980 | E01C 5/22 |
| GB | 2203463 | | 10/1988 | |
| GB | 2451856 | | 2/2009 | |
| JP | 03197758 | A * | 8/1991 | E04F 15/00 |
| JP | 2003117048 | A * | 4/2003 | A63C 19/06 |
| WO | 01/21909 | | 3/2001 | |
| WO | WO 02072970 | A1 * | 9/2002 | |
| WO | WO 2004033819 | A2 * | 4/2004 | |
| WO | WO 2004051028 | A1 * | 6/2004 | E04F 15/02 |
| WO | WO 2007037712 | A1 * | 4/2007 | |
| WO | WO 2007125476 | A1 * | 11/2007 | |
| WO | WO 2007129214 | A1 * | 11/2007 | |
| WO | WO 2009017629 | A1 * | 2/2009 | F21V 33/00 |
| WO | WO 2009087585 | A1 * | 7/2009 | E04F 15/02 |

OTHER PUBLICATIONS

PCT International Preliminary Report on Patentability issued on Aug. 7, 2012 for PCT Application PCT/EP2010/064735 filed on Oct. 4, 2010 in the name of Saint-Gobain Glass France (English + German).

PCT International Search Report mailed on May 7, 2012 for PCT Application PCT/EP2010/064735 filed on Oct. 4, 2010 in the name of Saint-Gobain Glass France (English + German).

* cited by examiner

ILLUMINATED FLOOR ASSEMBLY

CROSS REFERENCE TO RELATED APPLICATIONS

The present application is the US national stage of International Application PCT/EP2010/064735 filed on Oct. 4, 2010, which in turn, claims priority to German Patent Application No. 10 2009 044 180.8 filed on Oct. 5, 2009.

The invention relates to an illuminated arena floor, a method for its production, and its use.

Sports arenas are used for a large number of different types of sports. Examples include the classical ball sports of soccer, handball, volleyball, and basketball. Increasingly, other types of sports such as badminton and squash are also being added. Usually, sports arenas are used by different groups and associations. This entails intensive use of various types of sports. Accordingly, a correspondingly large number of lines and markings must be applied to the arena floors since the types of sports mentioned have greatly differing rules.

However, when many markings are applied to the floor of the playing area, this makes the orientation of the players on the playing area more difficult. In addition, it is more difficult for referees to recognize fouls. Moreover, during tournaments, the markings of the other types of sports have to be removed or covered. These measures are expensive and time-consuming. Illuminated floor panels made of safety glass represent one possibility for temporarily indicating markings. However, the illumination devices installed under the safety glass panes are in many cases quite difficult to access.

DE 39 25 742 A1 discloses an arena floor with a subfloor made of screed concrete and an elastic layer applied thereon. The elastic layer comprises at least two polyolefin plates that are glued together with a fleece.

US 2008/0287221 A1 discloses a base for a ball court. The base contains a plurality of adjacent safety glass panes freely movable vertically relative to each other that are aligned on a support and spring structure. Illumination devices enable the illumination of lines and markings.

The object of the invention is to provide an illuminated arena floor that is provided with a plurality of different colored lighting means and permits simple replacement and maintenance of the lighting means and control electronics.

The object of the present invention is accomplished according to the invention by an illuminated arena floor, a method for its production, and its use according to the independent claims 1, 14, and 15. Preferred embodiments emerge from the subclaims.

The illuminated arena floor comprises at least one composite glass floor panel. The composite glass floor panel preferably contains safety glass. A polymer block and a light channel are arranged between the composite glass floor panel and an overlay.

The light channel preferably contains LEDs and the corresponding electrical connections. Besides LEDs, other lighting means, such as incandescent bulbs, energy-saving bulbs, or halogen bulbs, can also be used. The light channel preferably includes differently colored LEDs that can be individually or jointly controlled. Thus, it is possible to generate moving light effects through the selective activation and extinction of individual LEDs. To the observer, the light appears to spread out in waves of color. If multiple colored waves are superimposed, further effects such as a colored moiré effect result. The light channel is laid under the composite glass floor panel along the playing field lines and enables selective illumination of the field lines of the selected type of sport. The light channel can also be laid out as a flat area and thus enable the representation of symbols and advertising.

The polymer block preferably contains an elastic polymer that exerts a cushioning effect on the composite glass floor panel.

A hook and loop fastener connects the polymer block to the composite glass floor panel. The hook and loop fastener enables simple, secure, and preferably reversibly detachable fastening of the polymer block to the composite glass panel.

The overlay is preferably configured as a metal and/or polymer panel or frame. The overlay ensures a level alignment of the composite glass floor panel and is borne by supports. The overlay can be a unperforated panel or a grid panel.

The supports are preferably aligned level on the foundation of the arena and the overlay.

Usually, the illuminated arena floor is made up of a plurality of composite glass floor panels, such that the above-described structure of composite glass floor panels, light channel, polymer block, overlay, and support is repeated over both the length and width of the foundation of the arena.

The composite glass floor panel preferably includes a composite glass pane and a connection joint. The connection joint connects the individual composite glass floor panels and seals the surface of the arena floor.

The composite glass floor panel preferably has a height from 4 mm to 20 mm, preferably 8 mm to 16 mm.

The composite glass floor panel preferably includes an anti-slip coating on the top. The anti-slip coating can be produced by etching the glass surface with an acid or base and/or printing with an enamel or ceramic paint. The enamel or ceramic paint is preferably applied as points or bumps.

The connection joint preferably contains cement, silicones, RTV (room-temperature-vulcanizing) silicone rubber, HTV (high-temperature-vulcanizing) silicone rubber, peroxide-vulcanized silicone rubber, addition-vulcanized silicone rubber, natural rubber, vulcanized rubber, polyisoprenes, styrene butadiene rubber, butadiene-acrylonitrile rubber, polyurethanes, polysulfides, polyepoxides, and/or polyacrylates as well as mixtures and/or copolymers thereof.

The connection joint is preferably manufactured from a liquid curable silicone.

The connection joint preferably contains acrylate adhesives, methyl methacrylate adhesives, cyanoacrylate adhesives, polyepoxides, silicone adhesives, and/or silane-curing polymer adhesives as well as mixtures and/or copolymers.

The connection joint preferably has a Shore-A hardness of >30, preferably >40. A definition of Shore hardness for elastomers is found in DIN 53505 and DIN 7868. The Shore-A hardness is preferably 30 to 90.

The light channel preferably contains a light source, particularly preferably an LED (light emitting diode) and/or OLED (organic light emitting diode).

The light channel preferably contains a delimiting profile made of metal and/or polymer, preferably aluminum, polyethylene, polypropylene, polyurethane, and/or mixtures and/or copolymers. The delimiting profile functions as a compartment for the light source and seals the light source against dust and moisture.

The polymer block preferably has a height from 5 mm to 30 mm, particularly preferably 15 mm to 25 mm.

The polymer block preferably contains silicones, RTV silicone rubber, HTV silicone rubber, peroxide-vulcanized silicone rubber, addition-vulcanized silicone rubber, natural rubber, vulcanized rubber, polyisoprenes, styrene butadiene rubber, butadiene-acrylonitrile rubber, and/or polyacrylates as well as mixtures and/or copolymers thereof.

The polymer block preferably contains, on the top and/or bottom, a flat aluminum frame. The flat aluminum frame preferably ends flush with the polymer pad. The flat aluminum frame is preferably located on the top between the hook and loop fastener and the polymer block and/or on the bottom between the polymer block and the overlay. The flat aluminum frame is preferably arranged, as described above, below a connection joint. The purpose of the flat aluminum frame is to press two adjacent glass panes downward together when a load is applied to one of them.

The overlay preferably contains, on the top and/or bottom, a flat aluminum frame. The flat aluminum frame is preferably arranged, as described above, below a connection joint.

The overlay preferably contains aluminum, iron, titanium, tungsten, chromium, molybdenum, and/or alloys thereof.

The overlay preferably contains polymers, carbon fibers, carbon-fiber reinforced polymers, and/or mixtures or copolymers.

The overlay preferably has a height from 5 mm to 20 mm, preferably 7 mm to 15 mm.

The supports preferably contain spring elements and/or spring supports.

The supports are preferably height adjustable. The supports can compensate for unevenness in the foundation of the arena and can be adapted to different arena floor heights.

The invention further includes a method for the production of an illuminated arena floor. In a first step, one or, usually, a plurality of supports are positioned on the floor foundation. Then, an overlay is placed and attached on the support. In the case of a plurality of supports, a plurality of overlays can be used. These are preferably attached to each other.

In the next step, a polymer block is attached on the overlay. The attachment can occur using an appropriate adhesive or mechanically using a screw, nail, clips, and/or a dowel. In the following step, the two associated parts of a hook and loop fastener are attached on the polymer block and a composite glass floor panel. The expression "associated parts of a hook and loop fastener" means, on the one hand, the loops, fabric, or strips and, on the other, the hooks of a hook and loop fastener. The hooks can be attached both on the composite glass floor panel and on the polymer block.

In a further step, a light channel is attached on the overlay and provided with electrical connectors.

In the final step, the composite glass floor panel is attached on the polymer block by means of the hook and loop fastener.

The invention further includes the use of the illuminated arena floor as a sports field, sports arena, gymnasium, particularly preferably as a handball court, volleyball court, hockey field, soccer field, and/or basketball court.

In the following, the invention is explained in detail with reference to drawings. The drawings are purely schematic and not to scale. They in no way restrict the invention.

Figure 2:
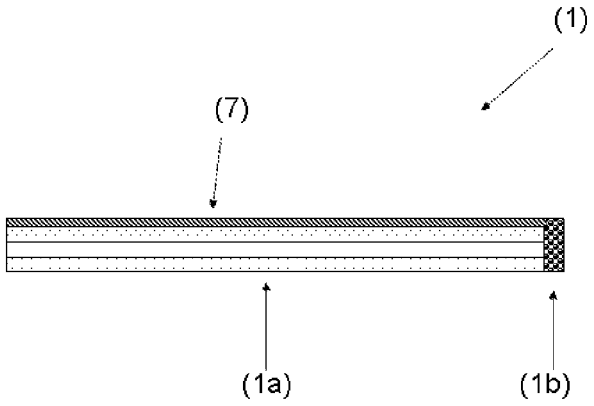
Figure 3:
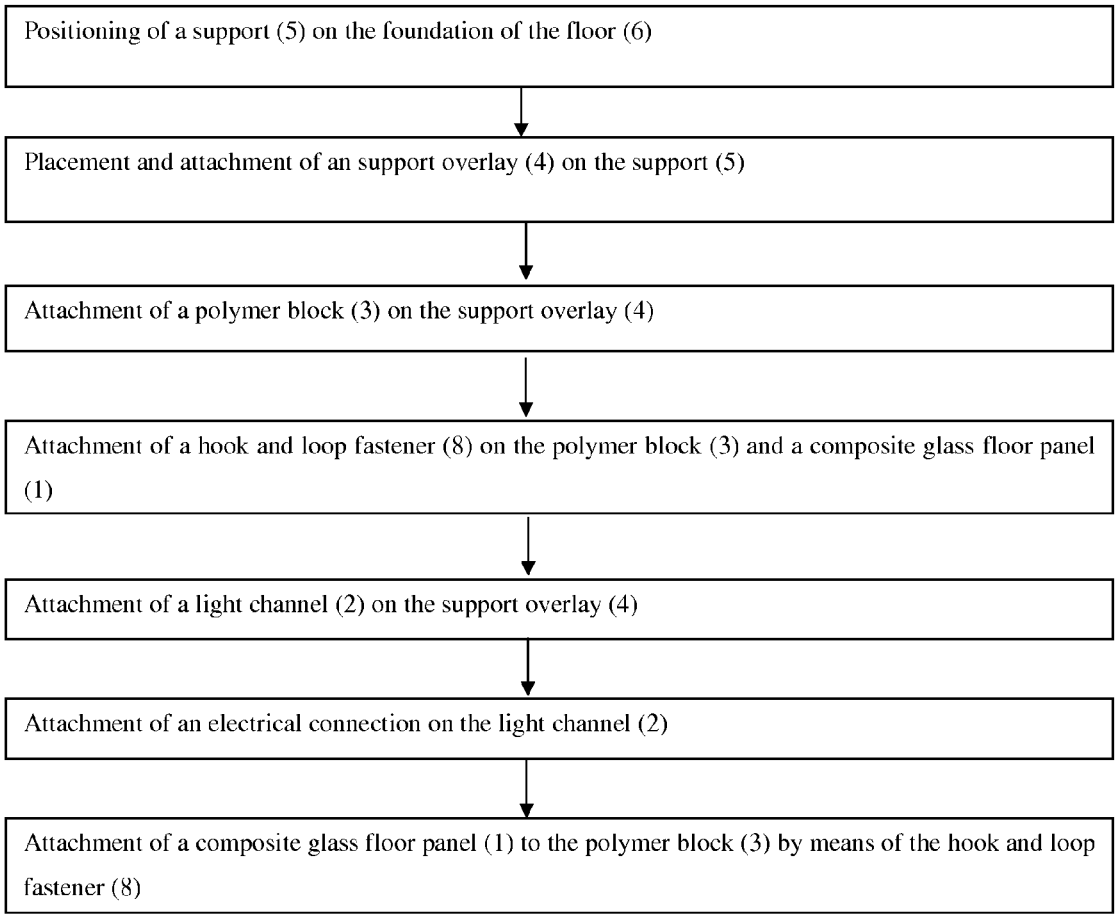
Figure 4:
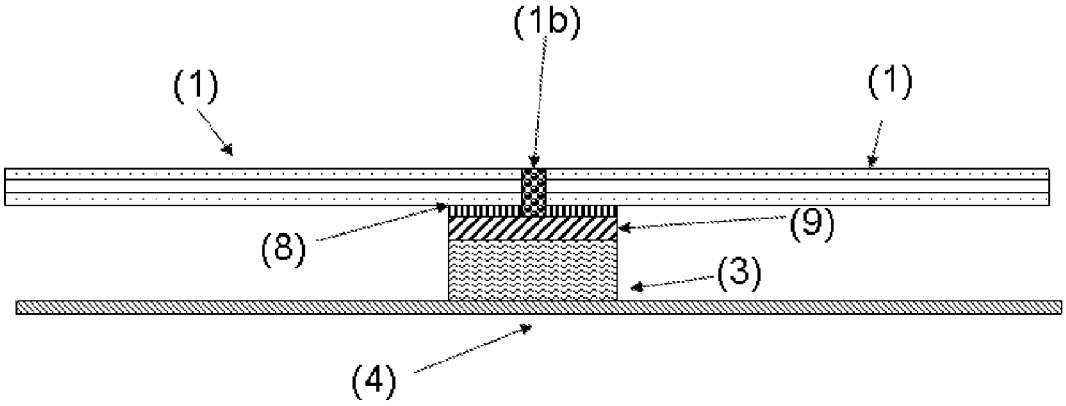

They depict:

FIG. 1 a cross-section of the illuminated arena floor (I) according to the invention, FIG. 2 a cross-section of a preferred embodiment of a composite glass floor panel (1), FIG. 3 a flow diagram of the method according to the invention for the production of an illuminated arena floor (I), and FIG. 4 a cross-section of a preferred embodiment of the polymer pad (3) according to the invention.

FIG. 1 depicts a cross-section of the illuminated arena floor (I) according to the invention. FIG. 1 depicts only one composite glass floor panel (1). The arena floor (I) is preferably made up of a plurality of composite glass floor panels (1) such that the structure depicted in FIG. 1 is repeated. The composite glass floor panel (1) is connected to a polymer block (3) by means of a hook and loop fastener (8). The polymer block (3) is attached on an overlay (4). A light channel (2) with electrical connections (not shown) is installed between the overlay (4) and the composite glass floor panel (1). The light channel (2) contains a light source (2*b*) and a delimiting profile (2*a*). A control device is also preferably arranged between the electrical connection cable and the power source. This control device enables the selective illumination of individual LEDs. Through the arrangement of differently colored LEDs on the LED circuit board, colored light effects can be generated. The overlay (4) is borne by a support (5). The support (5) is preferably height adjustable to enable compensation for slight unevenness in the foundation of the arena (6).

FIG. 2 depicts a cross-section of a preferred embodiment of a composite glass floor panel (1). The composite glass floor panel (1) preferably comprises a composite glass pane (1*a*), a connection joint (1*b*), and an anti-slip coating (7). A plurality of composite glass floor panels can be connected by the connection joint (1*b*).

FIG. 3 depicts a flow diagram of the process according to the invention for production of an illuminated arena floor (I). In a first step, at least one or, usually, a plurality of supports (5) are positioned on the floor foundation. The supports (5) are preferably height adjustable and provided with spring supports. By means of these spring supports, mechanical loads that act on the composite glass floor panel (1) can also be attenuated. Then, an overlay (4) is placed on the support (5) and attached with screws. The overlays (4) are preferably made of aluminum grid panels. In the next step, a polymer block (3) is attached on the overlay (4). The attachment can be effected using a suitable adhesive or mechanically by means of a screw, nail, and/or dowel. In the following step, the two associated parts of a hook and loop fastener (8) are attached on the polymer block (3) and a composite glass floor panel (1). In another step, a light channel (2) is attached on the overlay (4) and provided with electrical connectors. Preferably, a control device (not shown) is arranged between the electrical connection cable and the power source. This control device enables the selective illumination of individual LEDs. In the final step, the composite glass floor panel (1) is attached on the polymer block (3) by means of the hook and loop fastener (8). Usually, the illuminated arena floor (I) is made up of a plurality of composite glass floor panels such that the structure described is repeated over both the length and the width of the foundation of the arena (6). The composite glass floor panels (1) are then connected as described in FIG. 2. To increase stability, the individual overlays (4) can also be connected or one overlay (4) can be used for a plurality of composite glass floor panels (1).

FIG. 4 depicts a cross-section of a preferred embodiment of the polymer pad of the arena floor according to the invention. The polymer pad (3) is arranged under the connection joint (1*b*) centered between two composite glass floor panels (1). Between the hook and loop fastener (8) on each respective composite glass floor panel (1) and the polymer pad (3), a connecting flat aluminum frame (9) is arranged. The purpose of the flat aluminum frame (9) is to press two adjacent glass panes downward together when a load is applied to one of them. The flat aluminum frame is preferably also arranged (not shown) between the polymer pad (3) and the overlay (4) and/or the overlay (4) and the support (5).

LIST OF REFERENCE CHARACTERS

They represent:

(1) composite glass floor panel,
(1*a*) composite glass pane,
(1*b*) connection joint,
(2) light channel,
(3) polymer block,
(4) overlay,
(5) support,
(6) foundation of the arena,
(7) anti-slip coating,
(8) hook and loop fastener
(9) flat aluminum frame, and
(I) arena floor according to the invention.

The invention claimed is:

1. An illuminated arena floor, comprising:
a composite glass floor panel;
a connection joint;
an overlay;
a polymer block and a light channel next to each other between the composite glass floor panel and the overlay, the light channel being laid under the composite glass floor panel;
the light channel comprising a plurality of individually controlled light sources configured to enable selective illumination;
to form playing field lines; a flat metal frame located on a top of the polymer block and below the connection joint; a hook and loop fastener between the polymer block and the composite glass floor panel, the hook and loop fastener being directly located on a top of the metal frame and under the composite glass floor panel; and
one or more supports between the overlay and a foundation of the arena.

2. The arena floor according to claim 1, wherein the composite glass floor panel comprises a composite glass pane.

3. The arena floor according to claim 1, wherein the composite glass floor panel has a height from 4 to 20 mm.

4. The arena floor according to claim 1, wherein the composite glass floor panel comprises an anti-slip coating on top.

5. The arena floor according to claim 1, wherein the connection joint has a Shore-A hardness of greater than 30.

6. The arena floor according to claim 1, wherein the polymer block has a height from 5 mm to 30 mm.

7. The arena floor according to claim 1, wherein the overlay comprises one or more metals or one or more polymers.

8. The arena floor according to claim 7, wherein the one or more metals are selected from the group consisting one or more of: aluminum, iron, titanium, tungsten, chromium, molybdenum, or alloys thereof.

9. The arena floor according to claim 7, wherein the one or more polymers are selected from the group consisting one or more of: carbon fibers, carbon fiber reinforced polymers, or mixtures or copolymers.

10. The arena floor according to claim 1, wherein the overlay has a height from 5 mm to 20 mm.

11. The arena floor according to claim 1, wherein the supports comprise spring elements or spring supports.

12. The arena floor according claim 1, wherein the supports have a height from 70 mm to 250 mm.

13. The arena floor according claim 1, wherein height of the supports is adjustable.

14. A method comprising: using the illuminated arena floor according to claim 1 as a sports field, a sports arena, a gymnasium, a handball court, a volleyball court, a hockey field, a soccer field, or a basketball court.

15. The arena floor according to claim 1, wherein the composite glass floor panel has a height from 8 mm to 16 mm.

16. The arena floor according to claim 1, wherein the connection joint has a Shore-A hardness of greater than 40.

17. The arena floor according to claim 1, wherein the individually controlled light sources are LEDs or OLEDs.

18. The arena floor according to claim 1, wherein the polymer block has a height from 15 mm to 25 mm.

19. The arena floor according to claim 1, wherein the overlay has a height from 7 mm to 15 mm.

20. The arena floor according claim 1, wherein the supports have a height from 100 mm to 200 mm.

21. The arena floor according claim 1, wherein a control device of the light sources is arranged between a power source and electrical connections to the light channel.

22. The arena floor according claim 21, wherein the light sources are individually controlled by the control device.

23. The arena floor according claim 21, wherein the light sources are differently colored LEDs.

24. The arena floor according claim 23, wherein the control device enables selective illumination of individual LEDs to generate colored light effects.

25. A method for producing an illuminated arena floor, the method comprising:
positioning one or more supports on a floor foundation;
placing and attaching an overlay on the supports;
attaching a polymer block on the overlay;
arranging a flat metal frame on a top of the polymer block;
attaching a hook and loop fastener on the flat metal frame and a composite glass floor panel;
attaching a light channel on the overlay, in such a way that the light channel is laid under the composite glass floor panel;
providing the light channel with electrical connections, the light channel comprising a plurality of individually controlled light sources;
configuring the light sources to enable selective illumination to form playing field lines; and
attaching the composite glass floor panel on the flat metal frame polymer block with the hook and loop fastener.

* * * * *